US005951341A

United States Patent [19]

Rinzaki et al.

[11] Patent Number: 5,951,341

[45] Date of Patent: Sep. 14, 1999

[54] OUTBOARD ENGINE

[75] Inventors: Shoichi Rinzaki; Kunihiro Kitsu, both of Wako, Japan

[73] Assignee: Honda Giken Kogyo Kabushiki Kaisha, Tokyo, Japan

[21] Appl. No.: 08/992,321

[22] Filed: Dec. 17, 1997

[30] Foreign Application Priority Data

Dec. 19, 1996 [JP] Japan ..... 8-340183

[51] Int. Cl.[6] ..... B63H 20/32

[52] U.S. Cl. ..... 440/77

[58] Field of Search ..... 440/76, 77; 123/195 C, 123/195 P

[56] References Cited

U.S. PATENT DOCUMENTS 4,800,854 1/1989 Boda et al. .
5,055,074 10/1991 Westberg et al. .

FOREIGN PATENT DOCUMENTS 2-193797 7/1990 Japan .
8-99693 4/1996 Japan .

*Primary Examiner*—Sherman Basinger
*Attorney, Agent, or Firm*—Merchant & Gould P.C.

[57] ABSTRACT

An outboard engine includes an engine, a mount case for supporting the engine thereon, an undercase mounted to an upper part of the mount case, and an engine cover detachably secured to an upper part of the undercase and enclosing the engine together with the undercase. The undercase has a wall portion formed in opposed relation to a head cover of the engine. The wall portion is provided with a cutout opened in an upward direction in correspondence to the head cover and in a front-and-rear direction. The cutout is covered by a detachable lid. With this arrangement, it becomes possible to easily detach the large-sized head cover from the small-sized undercase, thereby allowing easy access to the engine for maintenance and inspection operations.

3 Claims, 5 Drawing Sheets

OUTBOARD ENGINE

BACKGROUND OF THE INVENTION

1. Field of the Invention

The present invention relates generally to an outboard engine and, more particularly, to an outboard engine having an engine housing case construction which allows easy access to an engine for maintenance and inspection operations relative to the engine.

2. Description of the Related Art

Conventionally, a technique is known from, for example, Japanese Patent Laid-Open Publication No. HEI 8-99693 entitled "HOUSING CASE FOR ENGINE OF OUTBOARD ENGINE ASSEMBLY", which allows easy access to the engine for maintenance and inspection operations of the engine.

The conventional outboard engine assembly comprises a vertical multi-cylinder engine and a housing case for enclosing the engine. The multi-cylinder engine includes a cylinder block having a plurality of cylinders laid horizontally in vertical juxtaposition, a crankshaft extending vertically therethrough, and a camshaft located oppositely from the crankshaft and extending vertically. The engine also includes a cylinder head and a head cover faced rearwardly of the outboard engine assembly. The housing case includes an undercase for covering a lower part of the engine and an engine cover for covering an upper part of the engine. The undercase is provided with two work apertures at portions thereof which are axially aligned with bolts for securing the cylinder head to the cylinder block. These apertures are normally closed by rubber closure members.

For performing maintenance and inspection works on the engine, the engine cover and head cover are removed. Then, the closure members are removed for allowing insertion of a tool through the apertures so that the bolts can be untightened to thereby allow removal of the cylinder head.

In certain instances, it is desired that the head cover be attached to a top end of the cylinder head such that it extends along an axis of the camshaft. To meet this desire, it is necessary for the head cover to have a large depth dimension, thereby making the head cover large in overall size. When applied to the conventional engine, such a large head cover cannot be detached easily, because the undercase obstructs the detachment. To overcome this problem, one may propose to size up the undercase but this requires up-sizing of the outboard engine and hence is undesirable.

SUMMARY OF THE INVENTION

It is therefore an object of the present invention to provide an outboard engine comprising a vertical multi-cylinder engine enclosed by an undercase and an engine cover, which further includes a head cover mounted to a top end of a cylinder head in such a manner as to extend along an axis of a camshaft but which does not require up-sizing of the undercase and allows easy access to an engine thereof for maintenance and inspection operations on the latter.

According to an aspect of the present invention, there is provided an outboard engine comprising: an engine having a cylinder block, a cylinder head connected to a back side of the cylinder block, and a head cover connected to a back side of the cylinder head, the cylinder block having formed therein a vertically extending crankshaft and a plurality of cylinders lying substantially horizontally; a mount case for supporting the engine thereon; an undercase mounted to an upper part of the mount case; an engine cover detachably secured to an upper part of the undercase and enclosing the engine jointly with the undercase; and the undercase having a wall portion formed in opposed relation to the head cover, the wall portion being provided with a cutout opening in an upward direction in correspondence to the head cover and in a front-and-rear direction, the cutout being covered with a detachable lid.

In the outboard engine thus arranged, it is possible to easily detach the large-sized head cover from the small-sized undercase, thereby allowing easy access to the engine for maintenance and inspection operations. In addition, notwithstanding the provision of the large-sized head cover, the undercase and hence the outboard engine can be kept to a minimum size.

In a preferred form, the lid has an upper surface held flush with an upper surface of a peripheral wall of the undercase, and both upper surfaces are held tightly against a lower surface of the engine cover via sealing packing sandwiched therebetween. Since the upper surfaces do not present any edged portions that may injure the sealing packing, sufficient seal can be achieved between the upper surfaces and the engine cover lower surface.

Preferably, the lid is bolt connected from upward to an inside of the undercase. The bolt connected portions of the undercase and the lid are invisible from outside and hence are desirable from an aesthetic point of view.

BRIEF DESCRIPTION OF THE DRAWINGS

A preferred embodiment of the present invention will be described in detail hereinbelow, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
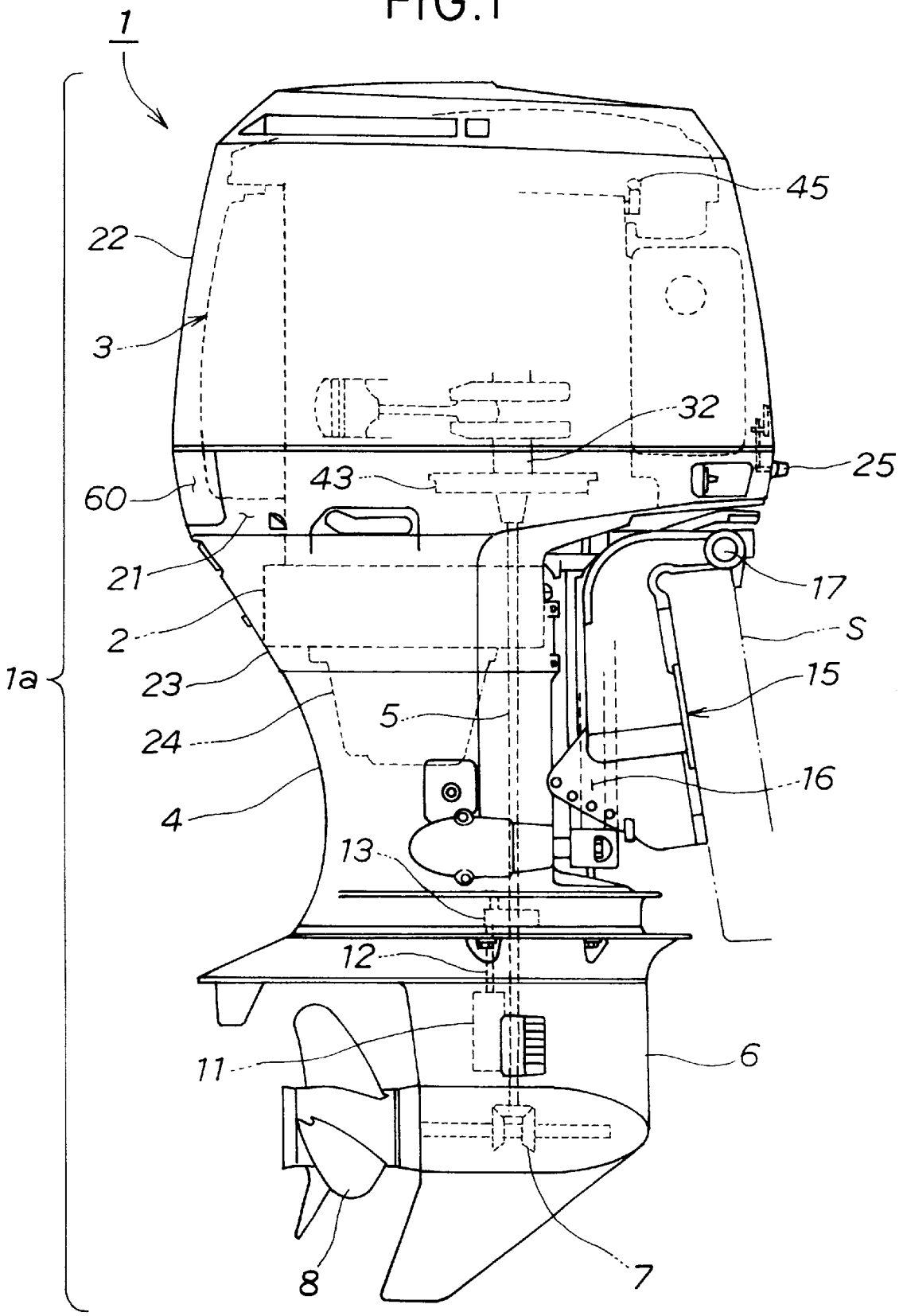
FIG. 1 is a side elevational view illustrating an outboard engine, as attached to a boat, embodying the present invention.

Referring initially to FIG. 1, an outboard engine 1 according to the present invention comprises an engine body 1*a* and an engine mounting mechanism 15 for mounting the engine body 1*a* to a boat S.

Engine body 1*a* includes a vertical multi-cylinder engine 3 which is mounted to a mount (engine support) case 2. Located below the mount case 2 is an extension case 4 defining an exhaust gas expansion chamber therein. A vertical drive shaft 5 passes through the extension case 4 for transmitting a motive power from the engine 3 to a propeller 8.

Gearcase 6 is disposed below the extension case 4. Within the gearcase 6, there is housed a bevel gear set 7 for shifting the forward and backward movements of the boat S. The propeller 8 is connected to an axle of the bevel gear and rotates in response to a driving force transmitted through the drive shaft 5. Within the extension case 4 and gearcase 6, there are provided a cooling water screen 11, a cooling water supply pipe 12, and a water pump 13.

Engine mounting mechanism 15 comprises metal fittings for securing the engine body 1*a* to the boat S. The engine mounting mechanism 15 supports the engine body 1*a* swingably about a swivel axis 16 in a front-and-rear direction of the figure. The engine body 1*a* is supported rotatably about a tilt axle 17 in a clockwise direction in the figure.

Engine 3 is covered by an engine cover 22 and an undercase 21. The undercase 21 and engine cover 22 are releasably connected together via a lock 25. Located below the undercase 21 is an undercover 23 for covering the mount case 2. The undercover 23 performs an ornamental function. An oil pan 24 is located below the mount case 2.

Figure 2:
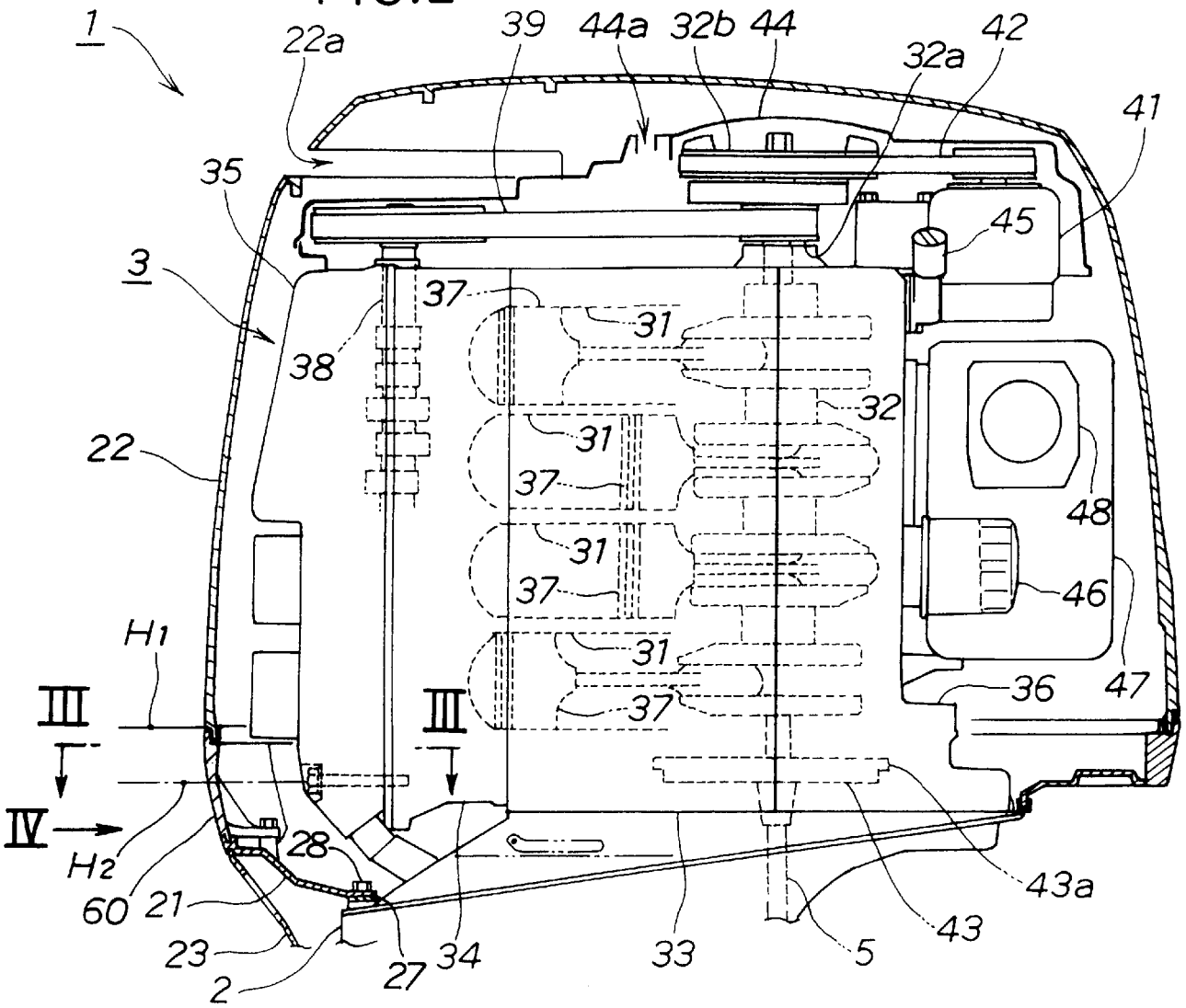
FIG. 2 is an enlarged view illustrating, partially in section, an engine body housed in the outboard engine.

Turning now to FIG. 2, the vertical multi-cylinder 3 is comprised of, for example, a water-cooled four-cylinder (four-cycle) engine. A plurality of cylinders 31 are arranged in vertical juxtaposition and extend substantially horizontally. A crankshaft 32 extends vertically. Thus, both the joining plane at which a cylinder block 33 and a cylinder head 34 meet and the joining plane at which the cylinder head 34 and a head cover 35 meet stand substantially vertical.

Engine 3 is positioned in lateral orientation so that the cylinder head 34 and head cover 35 are located rearwardly (left side in FIG. 1) of the outboard engine 1.

Reference numeral 36 designates a crankcase connected to the cylinder block 33 via bolts. Reference numeral 37 denotes a piston in each cylinder 31.

A first pulley 32*a* and a second pulley 32*b* are connected to an upper part of the crankshaft 32. A camshaft 38 is driven by a first belt 39 extending around the first pulley 32*a* while an AC generator 41 is driven by a second belt 42 extending around the second pulley 32*b*. Reference numeral 44 designates a belt cover for covering the first belt 39 and second belt 42. The belt cover 44 has a vent hole for expelling air inside the belt cover 44 out of the engine cover 22. The engine cover 22 has an air intake port 22*a* formed at an upper part thereof. A flywheel 43 with a ring gear 43*a* is mounted to a lower part of the crankshaft.

An oil injection port 45 is provided on a front side of the crankcase 36 in an inclined fashion. Reference numeral 46 designates an oil filter. An intake air silencer 47 defines therein a chamber for silencing an intake air. Designated by reference numeral 48 is a throttle valve device.

Undercase 21 is secured through an anti-vibration rubber 27 to the mount case 2 by a bolt 28.

Figure 3:
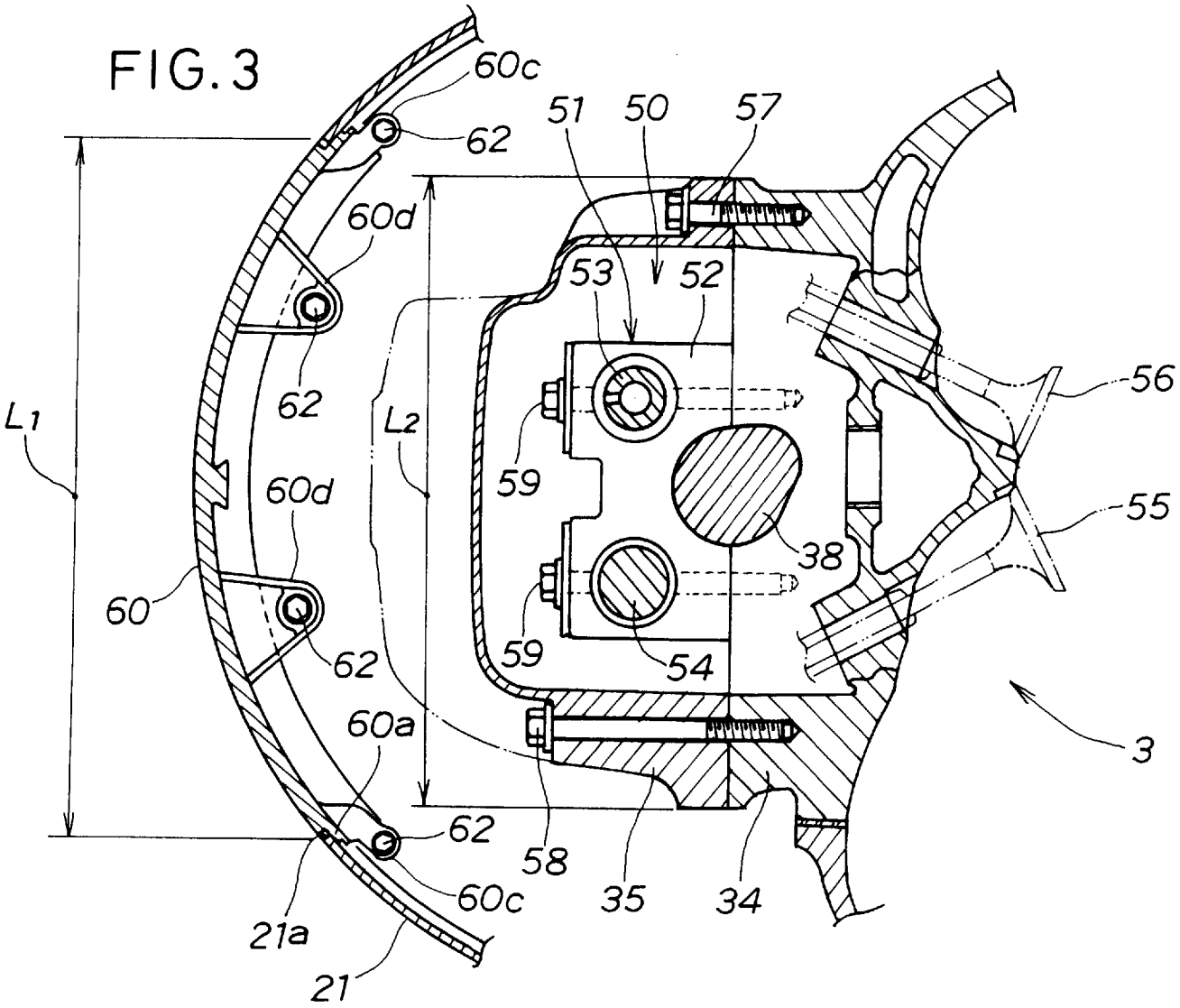
FIG. 3 is an enlarged sectional view taken along line III—III of FIG. 2.

As shown in FIG. 3, the head cover 35 is mounted to a top end of the cylinder head 34 such that it extends along an axis of the camshaft 38. The head cover 35 has a large depth and hence is relatively large in overall size.

Valve system chamber 50 is defined by the cylinder head 34 and head cover 35 and accommodates a valve system 51. The valve system 51 comprises a camshaft holder 52 which, jointly with the cylinder head 34, holds the camshaft 38. The camshaft holder 52 also supports rocker shafts 53, 54. Valves 55, 56 are driven by rocker arms not shown. Reference numerals 57, 58, 59, 59 designate bolts.

The bowl-shaped undercase 21 includes a wall portion 21' (see FIG. 5) opposed to part of the head cover 35 extending vertically (in the front-and-rear direction of the figure). The wall portion 21' of the undercase 21 is provided with a cutout 21*a* which corresponds in size to the head cover 35 and is opened in a front-and-rear direction. Stated otherwise, the cutout 21*a* provided in the peripheral wall of the undercase 21 opens in the direction of axes of the bolts 57, 58 which secure the head cover 35 to the cylinder head 34. The cutout 21*a* is covered by a lid 60 which is releasably secured thereto. The cutout 21*a* has a width L1 which is larger than a width L2 of the head cover 35.

Lid 60 is constructed such that it can be fit into the cutout 21*a* from inside the undercase 21, whereupon an external surface of the lid 60 becomes flush with an external surface of the peripheral wall of the undercase 21. In other words, the lid 60 is held from inside against the peripheral wall of the undercase 21 at an edge 60*a* thereof.

Figure 4:
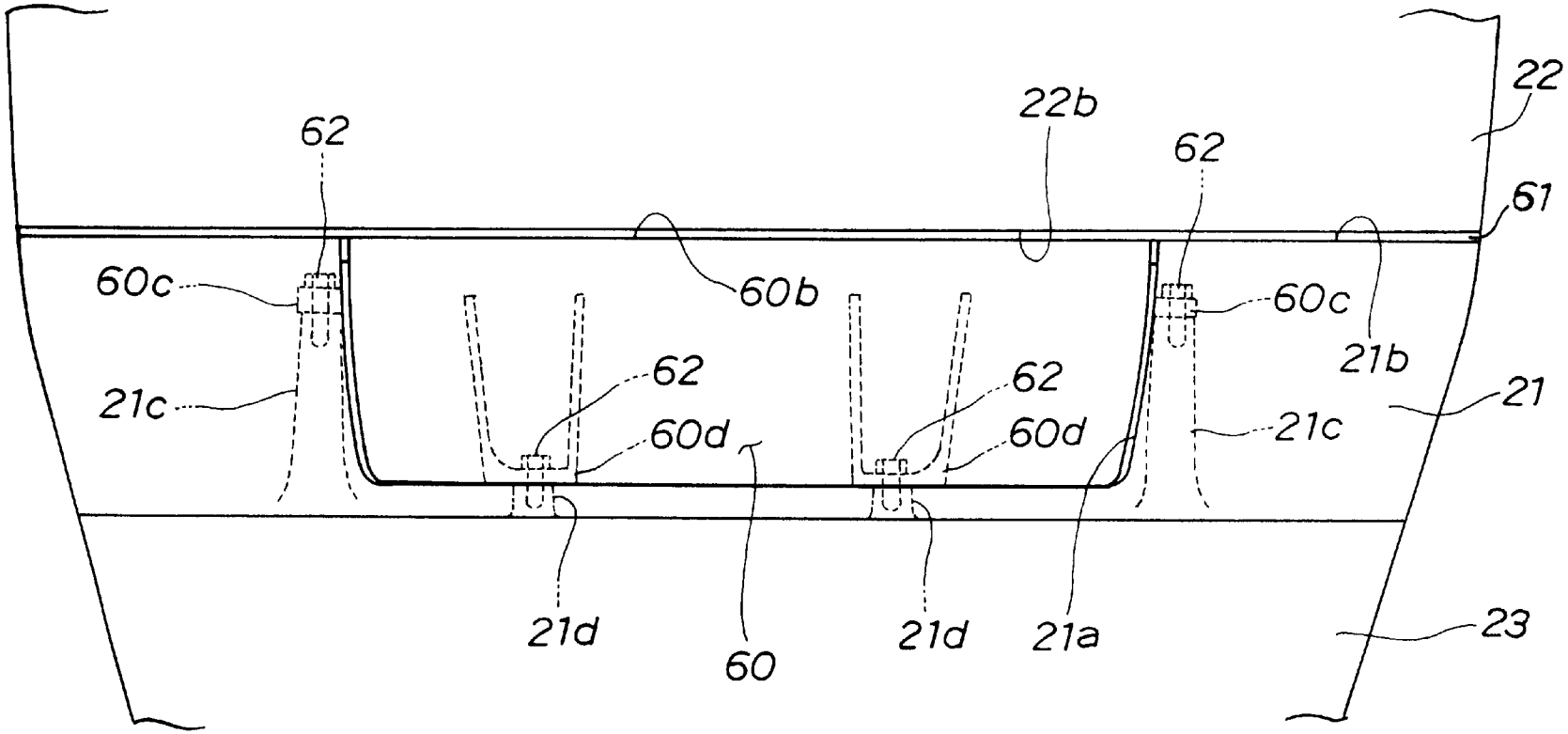
FIG. 4 is an enlarged view as seen from the direction of arrow IV of FIG. 2.

Referring now to FIG. 4, the cutout 21*a* is opened upwardly. An upper surface 60*b* of the lid 60 is flush with an upper surface 21*b* of the peripheral wall of the undercase 21. The upper surfaces 60*b*, 21*b* are tightly joined with an under surface 22*b* of the engine cover 22 via sealing packing or seal 61 made of, for example, rubber.

Lid 60 is bolt fastened to the undercase 21. The lid 60 also includes a pair of upper brackets 60*c*, 60*c* provided at an upper level on both sides thereof and a pair of lower brackets 60*d*, 60*d* provided internally of the lid closely to the center of the latter. The undercase 21 includes a pair of upper supports or seats 21*c*, 21*c* and a pair of lower supports or seats 21*d*, 21*d*, which are formed internally thereof. The upper brackets 60*c*, 60*c* and lower brackets 60*d*, 60*d* are placed upon respective upper seats 21*c*, 21*c* and lower seats 21*d*, 21*d* and fastened thereto by bolts 62.

The height of attachment of the lid 60 with respect to the undercase 21 is determined by the height of the contact surfaces between the upper seats 21*c*, 21*c* and upper brackets 60*c*, 60*c*. Thus, it becomes easy to place and keep upper surfaces 60*b*, 21*b* of the lid 60 and undercase 21 flush with each other. By virtue of the flush or linear packing surface thus formed jointly by the upper surfaces 60*b*, 21*b*, sufficient seal is achieved with respect to the engine cover 22. In other words, since the upper surfaces 60*b*, 21*b* do not present any stepped or edged portions along the packing surface, which may injure the seal 61, sufficient seal can be established between the packing surface and the engine cover 22.

After removal of the engine cover 22, the lid 60 can be removed by simply untightening the bolts 62 within the undercase 21 from above. The bolt fastened portions of the undercase 21 and the lid 60 are invisible from outside and hence are desirable from an aesthetic point of view.

Turning back to FIG. 2, mount level H2 of the bolts 57, 58 for mounting the head cover 35 falls within a range of the cutout 21*a* of the undercase 21. More specifically, the level of the upper surface 60*b* (FIG. 4) of the lid 60 is H1 while lower mount level of the bolts 57, 58 is H2. The level H2 is positioned higher than the lower surface of the cutout 21*a* of the undercase 21. A lower end of the cylinder head 34 and a lower end of the head cover 35 are positioned higher than the lower surface of the cutout 21*a*.

Figure 5:
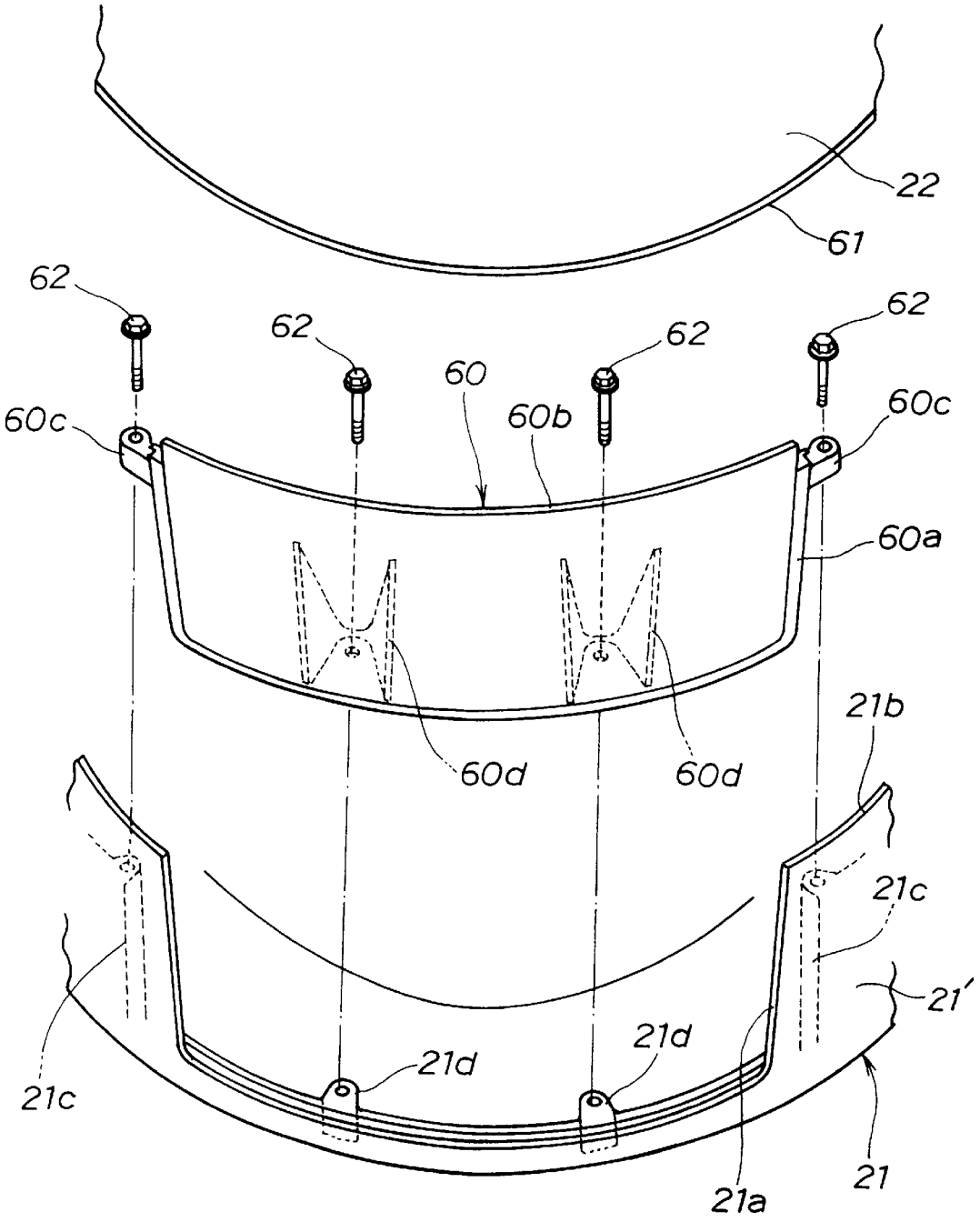
FIG. 5 is a schematic illustration of the process for removal of a lid according to the present invention.

Referring to FIG. 5 in combination with FIGS. 2–4, discussion will be made next as to the manner for performing maintenance and inspection operations on the engine 3 being mounted to the engine body 1*a*.

As shown in FIG. 5, the engine cover 22 is first removed. Then, the bolts 62 positioned internally of the undercase 21 are removed from above, following which the lid 60 is removed by pulling it upwardly.

Thereafter, the bolts 57, 58 as shown in FIG. 3 are removed so that the head cover 35 can be removed from the cylinder head 34. The head cover 35 is mounted to the cylinder head 34 to lie along the axis of the camshaft 38 and hence has a large depth dimension and is large in over-all size. However, since the width L1 of the cutout 21*a* is larger than the width L2 of the head cover 35, the head cover 35 can be removed easily by first pulling it toward the cutout 21*a* and then lifting it up. The same applies to mounting the head cover.

Lastly, the cylinder head 34 is removed from the cylinder block 33, whereby maintenance and inspection operations can be made on the engine 3 which remains mounted to the engine body 1*a*.

Engine 3 can be assembled again by following the above-described disassembling steps backwardly.

As can be appreciated from FIG. 2, with the engine 3 mounted to the engine body 1*a*, it is not possible to remove the undercase 21 from other cases (such as the mount case 2). However, the lower ends of the cylinder head 34 and head cover 35 are positioned higher than the lower end of the cutout 21*a*. As a result, after removal of the lid 60, the cylinder head 34 and head cover 35 can be removed through the cutout 21*a*, thereby allowing access to the inside of the engine 3 for maintenance and inspection operations on the latter, with the engine 3 and undercase 21 mounted to the engine body 1*a*.

In the above-described preferred embodiment of the invention, any number of the bolts 62 may be used for fastening the lid 60 to the undercase 21.

Obviously, various minor changes and modifications of the present invention are possible in the light of the above teaching. It is therefore to be understood that within the scope of the appended claims, the present invention may be practiced otherwise than as specifically described.

What is claimed is:

1. An outboard engine comprising:

an engine having a cylinder block, a cylinder head connected to a back side of said cylinder block, and a head cover connected to a back side of said cylinder head, said cylinder block having formed therein a vertically extending crankshaft and a plurality of cylinders lying substantially horizontally;

a mount case for supporting said engine thereon;

an undercase mounted to an upper part of said mount case;

an engine cover detachably secured to an upper part of said undercase for enclosing said engine jointly with said undercase; and said undercase having a wall portion formed in opposed relation to said head cover, said wall portion being provided with a cutout opened in an upward direction in correspondence to said head cover and in a front-and-rear direction, said cutout being covered by a detachable lid.

2. An outboard engine according to claim 1, wherein said lid has an upper surface placed flush with an upper surface of a peripheral wall of said undercase, and wherein said upper surfaces are held tightly against a lower surface of said engine cover via sealing packing sandwiched therebetween.

3. An outboard engine according to claim 1, wherein said lid is bolt connected from upward to an inside of said undercase.

* * * * *